US008870997B2

(12) United States Patent
Klekovkin et al.

(10) Patent No.: US 8,870,997 B2
(45) Date of Patent: Oct. 28, 2014

(54) IRON-BASED PRE-ALLOYED POWDER

(75) Inventors: Alexander Klekovkin, Johnstown, PA (US); David Milligan, Johnstown, PA (US); Nagarjuna Nandivada, Helsingborg (SE)

(73) Assignee: Hoganas AB (Publ), Hoganas (SE)

( * ) Notice: Subject to any disclaimer, the term of this patent is extended or adjusted under 35 U.S.C. 154(b) by 459 days.

(21) Appl. No.: 12/995,275

(22) PCT Filed: Jun. 5, 2009

(86) PCT No.: PCT/SE2009/050675

§ 371 (c)(1), (2), (4) Date: Dec. 10, 2010

(87) PCT Pub. No.: WO2009/148402

PCT Pub. Date: Dec. 10, 2009

(65) Prior Publication Data

US 2011/0103995 A1 May 5, 2011

Related U.S. Application Data

(60) Provisional application No. 61/129,150, filed on Jun. 6, 2008.

(51) Int. Cl.

| | |
|---|---|
| ***B22F 1/00*** | (2006.01) |
| ***B22F 1/02*** | (2006.01) |
| ***C22C 1/05*** | (2006.01) |

(52) U.S. Cl.
USPC ..... 75/252; 419/38

(58) Field of Classification Search
USPC ..... 75/252; 419/38
IPC ..... B22F 2999/00,1/0059, 3/24
See application file for complete search history.

(56) References Cited

U.S. PATENT DOCUMENTS

| | | | |
|---|---|---|---|
| 3,687,654 | A | 8/1972 | Huseby |
| 3,725,142 | A | 4/1973 | Huseby |
| 4,266,974 | A | 5/1981 | Nitta et al. |
| 4,437,891 | A | 3/1984 | Umino et al. |

(Continued)

FOREIGN PATENT DOCUMENTS

| | | | |
|---|---|---|---|
| EP | 653262 | A1 * | 5/1995 |
| JP | 58-130248 | A | 8/1983 |
| JP | 4-165002 | A | 6/1992 |
| WO | WO 98/03291 | | 1/1998 |
| WO | WO 03/106079 | A1 | 12/2003 |

OTHER PUBLICATIONS

International Search Report (PCT/ISA/210) issued on Sep. 30, 2009, by Swedish Patent Office as the International Searching Authority for International Application No. PCT/SE2009/050675.

(Continued)

*Primary Examiner* — Weiping Zhu
(74) *Attorney, Agent, or Firm* — Buchanan Ingersoll & Rooney P.C.

(57) ABSTRACT

A pre-alloyed iron-based powder is provided including small amounts of alloying elements which make possible a cost efficient manufacture of sintered parts. The pre-alloyed iron-based powder comprises 0.2-1% by weight of Cr, 0.05-0.3% by weight of Mo, 0.1-1% by weight of Ni, 0.09-0.3% by weight of Mn, 0.01% by weight or less of C, less than 0.25% by weight of O, and less than 1% by weight of inevitable impurities, the balance being iron.

24 Claims, 6 Drawing Sheets

(56) References Cited

U.S. PATENT DOCUMENTS

| | | | |
|---|---|---|---|
| 5,605,559 | A | 2/1997 | Unami et al. |
| 5,666,634 | A | 9/1997 | Unami et al. |
| 6,261,514 | B1 | 7/2001 | Lindberg et al. |
| 6,348,080 | B1 | 2/2002 | Arvidsson et al. |
| 2003/0233911 | A1 | 12/2003 | Engstrom et al. |
| 2006/0099105 | A1 | 5/2006 | Engstrom et al. |

OTHER PUBLICATIONS

International Preliminary Report on Patentability (PCT/IPEA/409) issued on Sep. 7, 2010, by Swedish Patent Office as the International Examining Authority for International Application No. PCT/SE2009/050675.

* cited by examiner

IRON-BASED PRE-ALLOYED POWDER

FIELD OF INVENTION

The present invention concerns a pre-alloyed iron based powder. Particularly the invention concerns a pre-alloyed iron-based powder including small amounts of alloying elements which permits a cost efficient manufacture of sintered parts.

BACKGROUND OF THE INVENTION

In industry the use of metal products manufacture by compacting and sintering metal-powder compositions is becoming increasingly widespread. A number of different products of varying shapes and thickness are being produced and the quality requirements are continuously raised at the same time as it is desired to reduce costs. The powder metallurgy (PM) technology enables a cost effective production of components, especially when producing complex components in long series, as net shape or near net shape components can be manufactured without the need of costly machining. A drawback however with the PM technology is that the sintered parts will exhibit a certain degree of porosity which may negatively influence the mechanical properties of the part. The development within the PM industry has therefore been directed to overcome the negative influence of the porosity basically along two different development directions.

One direction is to reduce the amount of pores by compacting the powder to higher green density (GD) facilitating sintering to a high sintered density (SD) and/or performing the sintering under such conditions that the green body will shrink to high SD. The negative influence of the porosity can also be eliminated by removing the pores at the surface region of the component, where the porosity is most harmful with regards to mechanical properties, through different kinds of surface densification operations.

Another development route is focused on the alloying elements added to the iron-based powder. Alloying elements may be added as admixed powders, fully pre-alloyed to the base iron powder or diffused to the surface of the base iron powder. Commonly used alloying elements are besides carbon, which is normally admixed in order to avoid a detrimental increase of the hardness and decrease of the compressibility of the iron-based powder, copper, nickel, molybdenum and chromium. The cost of alloying elements however, especially nickel, copper and molybdenum, makes additions of these elements less attractive. Copper will also be accumulated during recycling of scrap why such recycled material is not suitable to be used in many steel qualities where no or a minimum of copper is required.

Iron-based powders having low amounts of alloying elements without nickel and copper are previously known from e.g. the U.S. Pat. Nos. 4,266,974, 5,605,559, 5,666,634, and 6,348,080.

The purpose of the invention according to U.S. Pat. No. 4,266,974 is to provide a powder satisfying the demand of high compressibility and to provide a sintered body having good hardenability and good heat treatment properties. According to this prior art document, the most important step in the production of the steel alloy powder produced according to this prior art method is the reduction annealing step.

The U.S. Pat. Nos. 5,605,559 and 5,666,634 both concern steel powders including Cr, Mo and Mn. The alloy steel powder according to the U.S. Pat. No. 5,605,559 comprises, by weight, about 0.5-2% Cr, not greater than about 0.08% of Mn, about 0.1-0.6% of Mo, about 0.05-0.5% of V, not greater than about 0.015% of S, not greater than about 0.2% of O, and the balance being Fe and incidental impurities. The U.S. Pat. No. 5,666,634 discloses that the effective amounts should be between 0.5-3% of chromium, 0.1-2% by weight of molybdenum and at most 0.08% by weight of manganese.

A serious drawback when using the invention disclosed in the U.S. Pat. Nos. 5,605,559 and 5,666,634 is that cheap scrap can not be used as this scrap normally includes more than 0.08% of manganese. In this context the U.S. Pat. No. 5,605,559 teaches that "when Mn content exceeds about 0.08% wt, oxide is produced on the surface of alloy steel powders such that the compressibility is lowered and hardenability increased beyond the required level . . . . Mn content is preferably not greater than about 0.06% wt (col 3, 47-53).

The U.S. Pat. No. 5,666,634 refers to a Japanese Laid-Open No. 4-165 002 which concerns an alloy steel powder including in addition to Cr also Mn, Nb and V. This alloy powder may also include Mo in amount above 0.5% by weight. According to the investigations referred to in the U.S. Pat. No. 5,666,634, it was found that Cr-based alloy steel powder is disadvantageous due to the existence of the carbides and nitrides which act as sites of fracture in the sintered body.

The U.S. Pat. No. 3,725,142 discloses an atomized steel powder having improved hardenability. However, improved hardenability is in this case achieved by intentional additions of boron. "According to the invention boron is added to the melt in amount of 0.005-0.100 percent by weight and preferably in the range of 0.0075-0.0500 percent by weight" (col 2, 59-62). Alloying with boron at such low additions not only creates problems regarding reproducibility, but also requires adaptation of the standard water atomizing process in order to ensure success (as described in Col3, 27-65), thus increasing production cost.

The possibility of using powders from scrap is disclosed in the U.S. Pat. No. 6,348,080 which discloses a water-atomised, annealed iron-based powder comprising, by weight % Cr 2.5-3.5, Mo 0.3-0.7, Mn 0.09-0.3, O<0.2, C<0.01 the balance being iron and, an amount of not more than 1%, inevitable impurities. This patent also discloses a method of preparing such powder. Additionally, the U.S. Pat. No. 6,261,514 discloses the possibility of obtaining sintered products having high tensile strength and high impact strength if powders having a composition as disclosed in U.S. Pat. No. 6,348,080 is warm compacted and sintered at a temperature above 1220° C.

The international patent application WO 03-106079 describes a low alloyed steel powder having an amount of chromium between 1.3 to 1.7% by weight, molybdenum between 0.15-0.3%, manganese between 0.09-0.3%, not more than 0.01% of carbon and not more than 0.256% by weight of oxygen. It is further taught that nickel and/or copper may be admixed to the powder or adhered to the surface of the powder by using a bonding agent or being diffusion bonded to the surface.

It is stated in the WO application 03-106079 that the maximum allowable partial pressure of oxygen is $5\times10^{-18}$ atm in the sintering atmosphere when sintering green components produced from compacted powders as described in U.S. Pat. No. 6,348,080, whereas the corresponding value for allowable partial pressure of oxygen for the sintering atmosphere is $3\times10^{-17}$ atm when sintering components made of powders according to WO 03-106079. Nothing else is taught about the sintering atmosphere but due to the very low partial pressures of oxygen, the in PM production normally used Endogas atmosphere is not suitable due to its high partially pressure of oxygen. The choice of atmospheres during sintering is therefore limited to more expensive hydrogen containing atmospheres such as 100% of hydrogen or hydrogen mixed with nitrogen for example 90% hydrogen/10% of nitrogen.

Hence, there is a need of an iron-based alloyed steel powder having lower amounts of costly alloying elements, suitable to be compacted into green components which may be sintered in atmospheres having relatively high partial pressures of oxygen such as the Endogas normally used in the PM industry.

It has now surprisingly been found that a Cr/Mo/Mn/Ni containing iron-based alloyed steel powder can suitably be used for producing compacted and sintered parts having a sufficiently high mechanical strength after heat treatment in an Endogas atmosphere comparable to parts produced from powders according to the MPIF standard FN 0205 or FLN2-4405-HT. The new powder may also be sintered in an Endogas atmosphere having relatively high partial pressure of oxygen. According to the present invention other gases than Endogas can be used if the gas atmosphere has a partial oxygen pressure similar to the partial oxygen pressure in Endogas and if the gas can be produced at a relatively low price. Endothermic gas (Endogas) is a blend of carbon monoxide, hydrogen, and nitrogen with smaller amounts of carbon dioxide water vapour, and methane produced by reacting a hydrocarbon gas such as natural gas (primarily methane), propane or butane with air. For Endogas produced from pure methane, the air-to-methane ratio is about 2.5; for Endogas produced from pure propane, the air-to-propane ratio is about 7.5. These ratios will change depending on the composition of the hydrocarbon feed gases and the water vapour content of the ambient air. Endogas is produced in a special generator by incomplete combustion of a mixture of fuel gas and air, using a catalyst. It is possible to produce an Endogas atmosphere having a partial pressure of oxygen of about $10^{-15}$ to $10^{-16}$ which partial pressure of oxygen is sufficient to allow sintering of the new material.

SUMMARY

Embodiments of the invention disclosed herein provide a new pre-alloyed powder including low amounts of alloying elements.

Embodiments of the invention disclosed herein provide a new pre-alloyed powder which can be cost effectively sintered in industrial scale in an Endogas and nitrogen/hydrogen atmosphere.

Embodiments of the invention disclosed herein provide a new pre-alloyed powder which can be cost effectively compacted and sintered into components having mechanical properties according to MPIF Standard FN 0205 or FLN2-4405-HT after heat treatment in a normal Endogas heat treatment atmosphere.

Embodiments of the present invention relate to a pre-alloyed iron-based powder comprising or consisting essentially of or consisting of the following amounts of alloying elements: 0.2-1% by weight of Cr, preferably 0.3-0.7%, 0.05-0.3% by weight of Mo, preferably 0.05-0.15%, 0.1-1% by weight of Ni, preferably 0.3-0.7%, 0.09-0.3% by weight of Mn, 0.01% by weight or less of C, less than 0.25% by weight of O, less than 1% by weight of inevitable impurities, the balance being iron.

Embodiments of the invention relate to compacted and sintered products prepared from this powder optionally mixed with Cu, Ni, or Mn-containing powders, graphite, lubricants, binders, hard phase materials, flow enhancing agents, machinability improving agents, or combinations thereof.

DETAILED DESCRIPTION OF THE INVENTION

Preparation of the New Powder

The alloy steel powder of the invention can be readily produced by subjecting molten steel prepared to have the above defined composition of alloying elements to any known water-atomising method. For the further processing according to the present invention this water-atomised powder could be annealed according to the method described in PCT/SE97/01292 (which is hereby incorporated by reference).

Amount of Chromium

The component Cr is a suitable alloying element in steel powders, since it provides sintered products having improved hardenability but not significantly increased ferrite hardness. To obtain sufficient strength after sintering and still maintain a good compressibility a Cr range of 0.2-1% by weight of Cr, preferably 0.3-0.7%, may be used.

Amount of Manganese

Manganese is an alloying element improving the hardenability and it also improves the strength of the sintered component through solid solution hardening. However, if the amount of Mn exceeds 0.3% the compressibility of the steel powder will be negatively influenced. If the amount of Mn is less than 0.08% it is not possible to utilise cheap scrap that normally has a Mn content above 0.08, unless a specific treatment for reducing Mn during the course of the steel manufacture is carried out. Thus the preferred amount of Mn according to the present invention is 0.09-0.3%.

Amount of Molybdenum

When the component Mo is used as alloying element, it serves to improve the strength of the sintered component through improvement of hardenability and solid solution hardening. In combination with the Cr-content, Mn-content and Ni-content according to the present invention, contents of Mo as low as 0.05-0.3% by weight, preferably 0.05-0.15% will have a desired effect.

Amount of Nickel

Nickel prohibits the formation of carbides by increasing the solubility of carbon in austenite prior to cooling or quenching during sintering or heat treatment. By avoiding formation of carbides at high temperatures the formation of grain boundary carbides is avoided at the sintering process. During heat treatment carbide formation will deplete the surrounding matrix of carbon and other alloying elements. This is counteracted by nickel addition. An addition of nickel less than 0.1% will have no effect and an addition of nickel above 1% is not necessary for the purpose of this invention.

Amount of Carbon

The amount of carbon in the steel powder is kept at 0.01% by weight or less in order not to negatively influence the compressibility as carbon will harden the ferrite matrix through interstitial solid solution hardening.

Amount of Oxygen

A high level of oxygen content is detrimental to sintered and mechanical properties. The amount of oxygen should not exceed 0.25% by weight. The oxygen content should be limited to less than about 0.2% by weight and normally be less than 0.15%.

Graphite

Graphite is normally added to powder metallurgical mixtures or compositions in order to improve the mechanical properties. Graphite may also act as a reducing agent further reducing the amount of oxides during sintering. The amount of carbon in the sintered product is controlled by the amount of graphite added to the iron-based powder according to the invention. Typically graphite is added in the amount up to 1% by weight of the iron-based powder combination.

Lubricant

Lubricating agents may also be admixed to the iron-based powder composition to be compacted. Representative examples of lubricants used at ambient temperatures (low temperature lubricants) are Kenolube®, ethylene-bis-stearamide and metal stearates such as zinc stearate, fatty acids or fatty acid primary amides such as oleic amide, fatty acid secondary amides or other fatty acid derivates. Representative examples of lubricants used at elevated temperatures (high temperature lubricants) are polyamides, amide oligomers, polyesters or lithium stearate. The lubricant is normally added in an amount of up to 1% by weight of the composition.

Other Additives

Other additives which may optionally be admixed with the powder according to the invention include hard phase material, machinability improving agents and flow enhancing agents.

Mn-containing powders, such as FeMn and the like, may optionally be admixed with the powder according to the invention in order to alloy with manganese without affecting compressibility inversely.

Cu-containing powders may optionally be admixed with the powder according to the invention. Such additions are relevant for providing dimensional stability control, as copper produces swelling during sintering.

Ni-containing powders may optionally be admixed with the powder according to the invention. Such additions are relevant for providing dimensional stability control, as nickel produces shrinking during sintering.

Compaction and Sintering

Compaction may be performed in an uniaxially pressing operation at ambient or elevated temperature at pressures between 400-2000 MPa, normally at pressures between 400-1000 MPa, or e.g. at pressures between 500-900 MPa, After compaction sintering of the green component is obtained at a temperature between 1000 to 1400° C. Sintering in the temperature range of 1050-1220° C., normally 1100-1200° C. leads to a more cost effective production. An interesting property of the powder disclosed herein compared to conventional chromium containing low alloy powders is that sintering of compacted bodies may be performed in an Endogas atmosphere having a relative high partial pressure of oxygen compared to dry hydrogen or dry hydrogen/nitrogen atmospheres which are normally applied when sintering chromium containing low alloyed steel powders. High sintering temperatures, 1200-1400° C., normally 1200-1300° C., may be used if the powder has been admixed with an Mn-containing compound, such as FeMn powder.

After sintering, heat treatment of the sintered parts may be performed in order to reach sufficient mechanical strength. Also the heat treatment may be performed in an Endogas atmosphere in contrast to heat treatment sintered parts made of conventional chromium containing low alloyed steel powders where heat treatment is performed under a dry hydrogen or hydrogen/nitrogen atmosphere or in vacuum. Examples of heat treatments that may be used to achieve desired properties of sintered components are: through hardening, precipitation hardening, case hardening, vacuum carburizing, nitriding, carbonitriding, plasma nitriding, nitrocarburizing, induction hardening, steam treatment and phosphatising.

The possibility of using less costly atmospheres during sintering and heat treatment and still obtaining sufficient mechanical strength in combination with low amounts of costly alloying elements make the new powder an attractive alternative to conventional chromium based low alloyed steel powders. Examples of components suitable to be produced with this powder are: automotive transmission clutches, synchronizer hubs, bearing caps, gears and the like.

Examples

The following examples illustrates that the new powder can meet the requirements according to MPIF STANDARD 35. Especially, components made from the new powder shows a much lower dimensional change between die and sintered-heat treated stage compared to components made of FN-0205 (0% Cu) and FN0205 (2% Cu) materials. Furthermore, hardened material produced from the new powder obtained much higher apparent hardness than similar processed material based on FN-0205-HT.

The new powder was produced from a water atomized iron-base melt containing the alloying elements Cr, Mo, Ni and Mn. The chemical composition in percent by weight of the powder after annealing is shown in table 1:1 below. The particle size distribution of the powder is shown in table 1:2 below.

TABLE 1:1

| Alloying element | % by weight |
|---|---|
| Cr | 0.56% |
| Mo | 0.11% |
| Mn | 0.10% |
| Ni | 0.55% |
| O | 0.14% |
| C | 0.01% |

TABLE 1:2

| Portion | Amount passing |
|---|---|
| +100 mesh | 4.3% |
| +140 mesh | 20.0% |
| +200 mesh | 23.2% |
| +375 mesh | 28.7% |
| −375 mesh | 23.7% |

Two premixes, A and B, were made based on the new powder, graphite and lubricant. In premix A, 0.2% of Asbury 1651 graphite, and in premix B 0.6% of the same graphite were added, in both premixes 0.6% of lubricant Kenolube, available from Höganäs AB, were further added.

The mixes were further compacted into Transverse Rupture Strength (TRS) samples and into impact energy (IE) samples by uniaxially compaction in order to obtain desired green density of 7.10 g/cm$^3$. To achieve green density of 7.30 g/cm$^3$, the double press-sinter technique was used, first pressing at 593 MPa followed by sintering at 787° C. for 15 minutes. A second uniaxilly press operation was performed at 662 MPa, thereafter, followed by a second sintering operation at 1121° C. The specimens for tensile strength were machined from impact energy bars to get round test bars according to MPIF10 standard. The test specimens were sintered and cooled with normal cooling rates in an Abbot 6 inch mesh belt furnace with conventional nitrogen-hydrogen atmosphere as well as in endogas at conditions according to table 2.

TABLE 2

| | | |
|---|---|---|
| Atmosphere | $N_2/H_2$ (N) | Endogas (E) |
| Sintering temperature | 1120° C. | 1110° C. |
| Sintering time | 30 min | 25 min |
| Cooling rate | 0.5 C./second | 0.5 C./second |

Heat treatment of the samples was performed according to the following table 3.

TABLE 3

| Type of heat treatment | Premix A Case hardening | Premix B Through hardening |
|---|---|---|
| Temperature | 899° C. | 843° C. |
| Carbon potential | 0.8% C | 0.6% C |
| Soak time | 30 minutes | 90 minutes |
| Atmosphere | Endothermic gas | |
| Quenching | Oil 60° C. | |
| Tempering | 177° C./1 hour | |

Testing

Carbon and oxygen contents were determined for samples produced after sintering using Leco infrared combustion analyzers according to ASTM E 1019-02. Dimensional change was tested using TRS samples after each type of sintering and heat treatment according to MPIF standard 44. Apparent hardness, TRS impact energy and tensile strength were evaluated for both materials as sintered and as heat treated for both densities, sintering conditions and heat treatments per MPIF standards 43, 44, 40 and 10. Determination of microindention hardness and effective case depth were performed according to MPIF standards 51 and 52.

Results are shown in the FIGS. 1-12 where:

Figure 1:
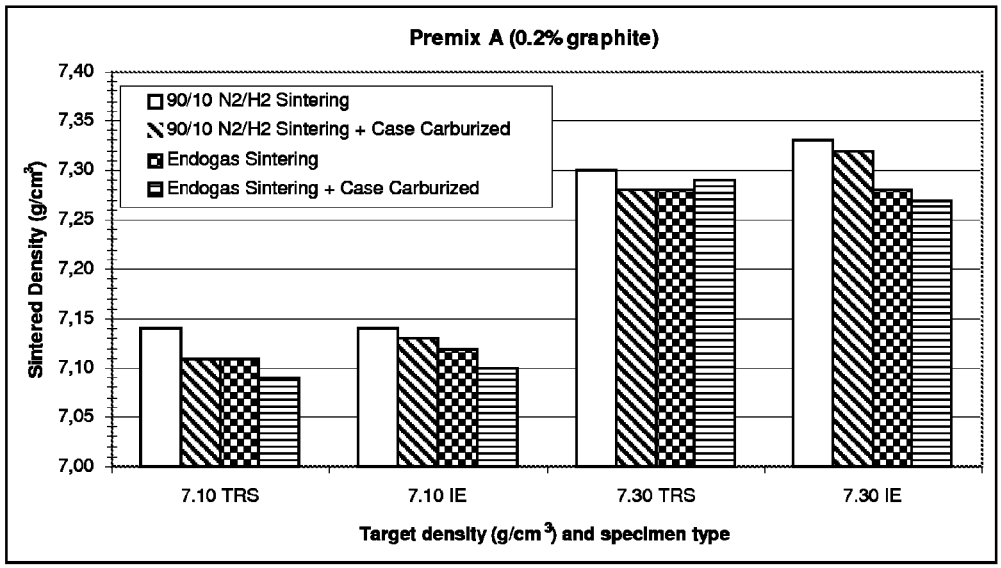
FIG. 1 shows densities obtained after sintering and heat treatment of samples produced from premix A.
Figure 2:
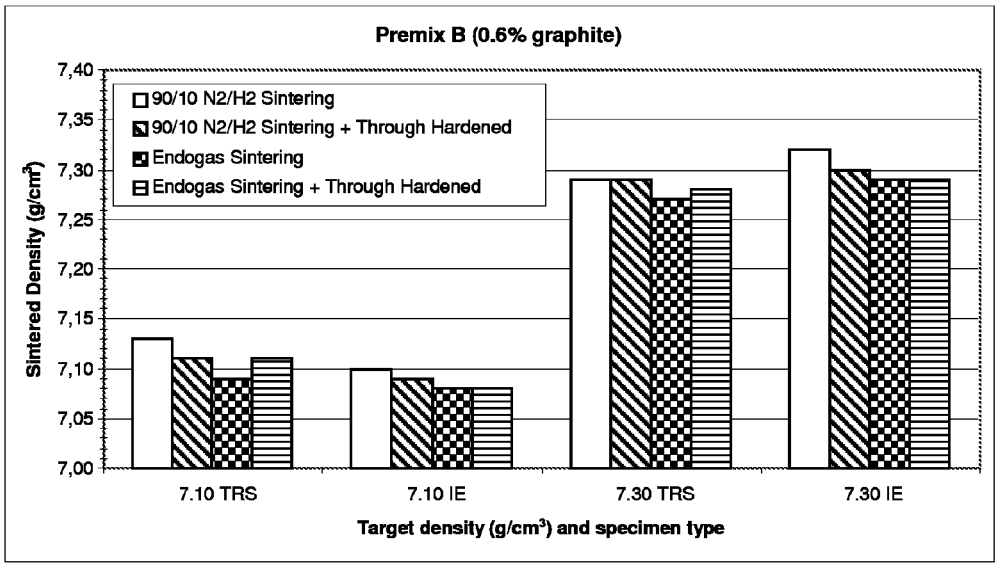
FIG. 2 shows densities obtained after sintering and heat treatment of samples produced from premix B.
Figure 3:
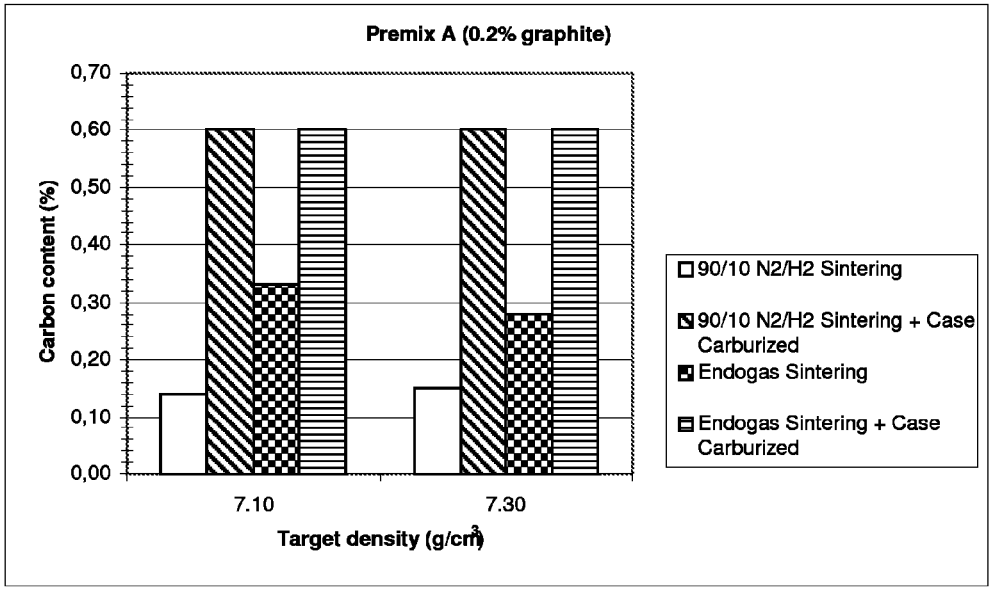
FIG. 3 shows carbon content for premix A.
Figure 4:
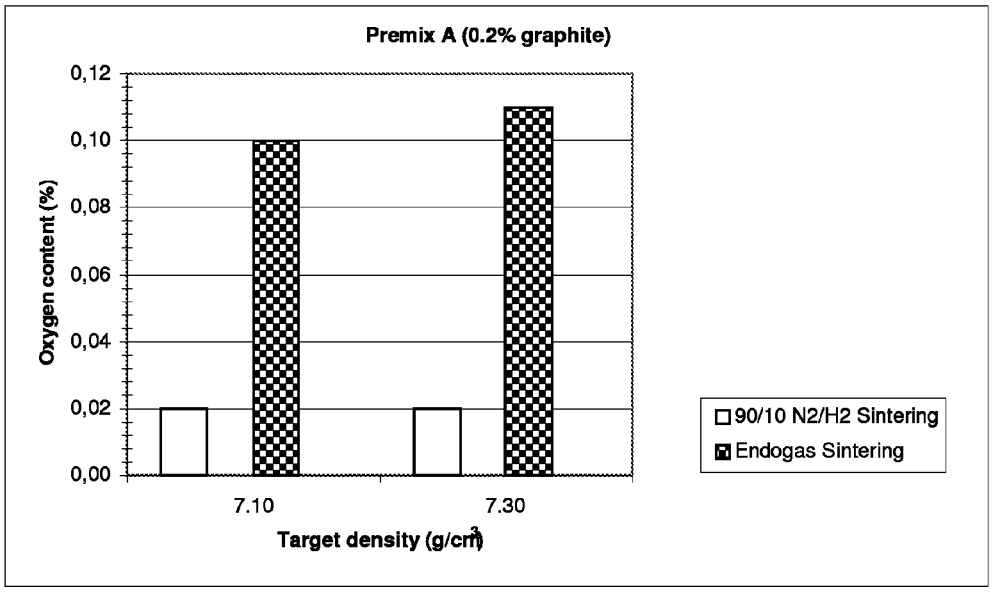
FIG. 4 shows oxygen content for premix A.
Figure 5:
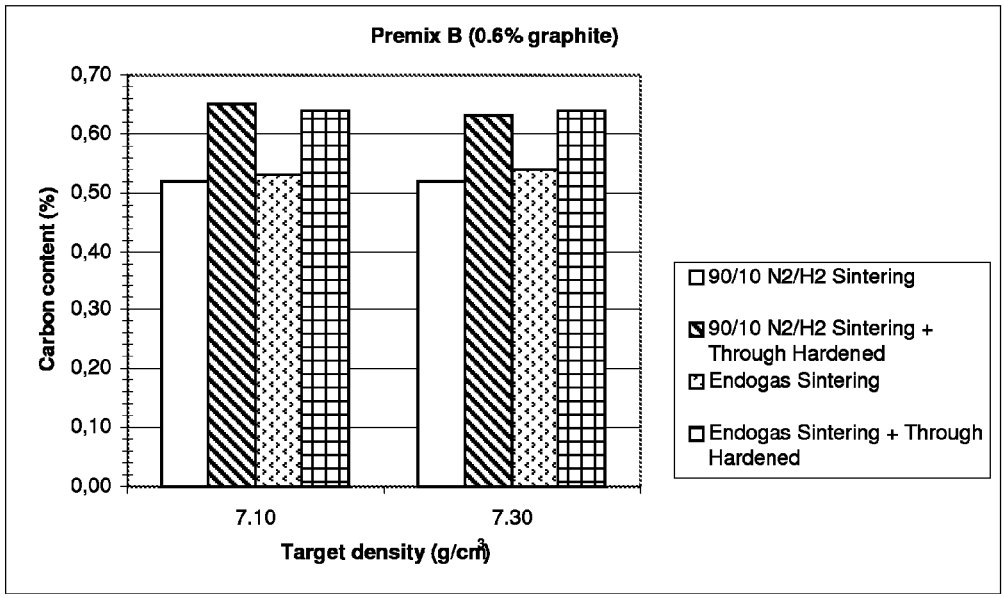
FIG. 5 shows carbon content for premix B.
Figure 6:
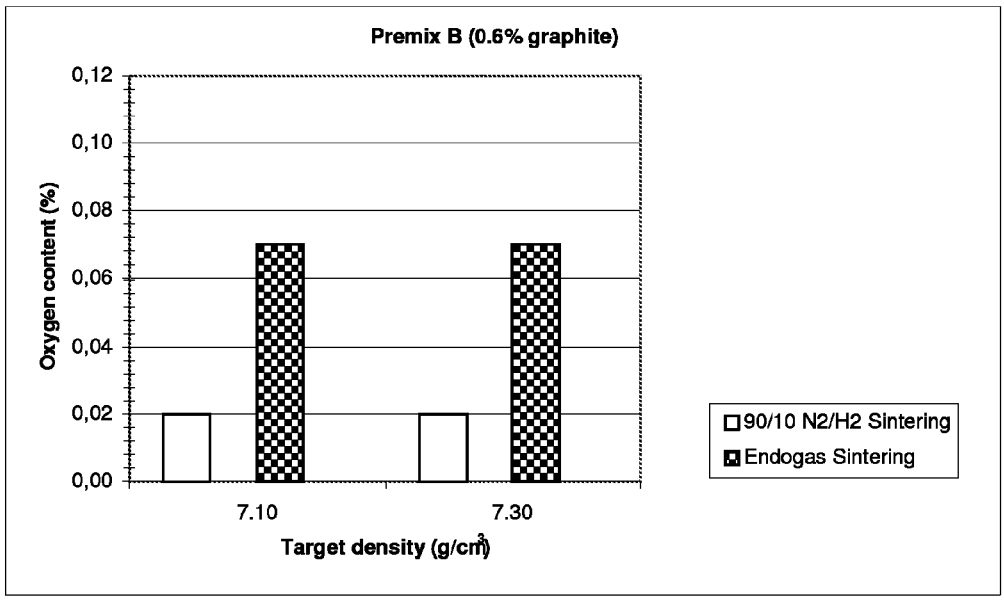
FIG. 6 shows oxygen content for premix B.
Figure 7:
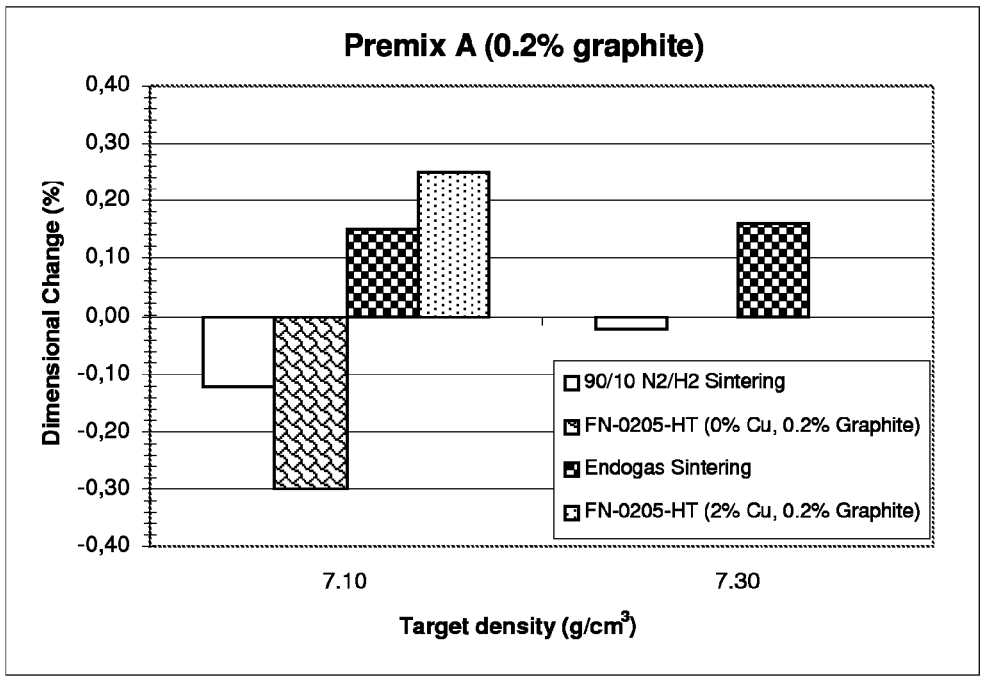
FIG. 7 shows dimensional change for premix A.
Figure 8:
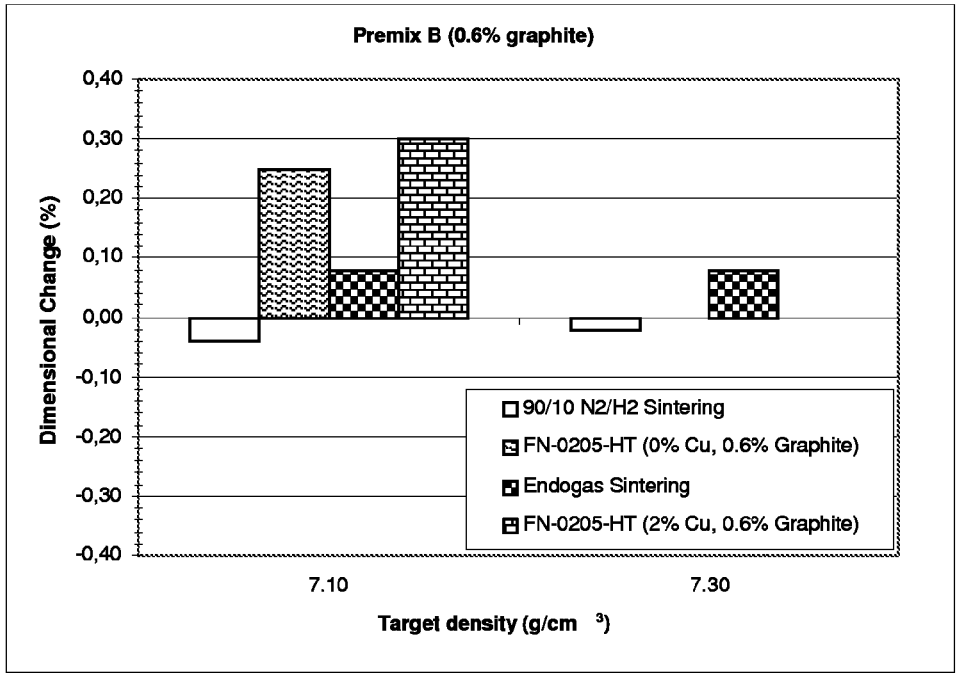
FIG. 8 shows dimensional change for premix B.
Figure 9:
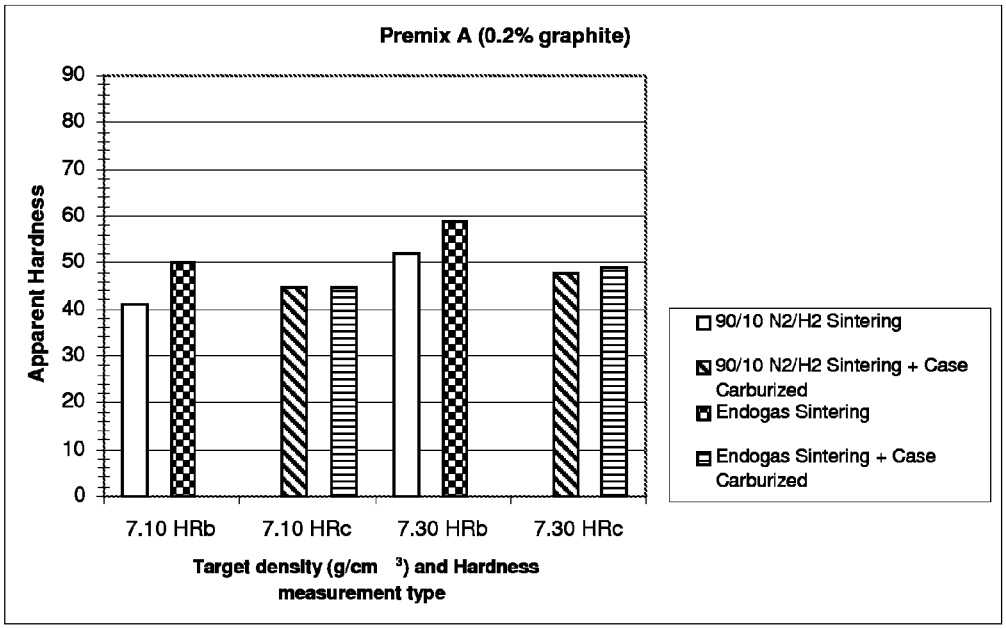
FIG. 9 shows apparent hardness obtained after sintering and heat treatment for premix A.
Figure 10:
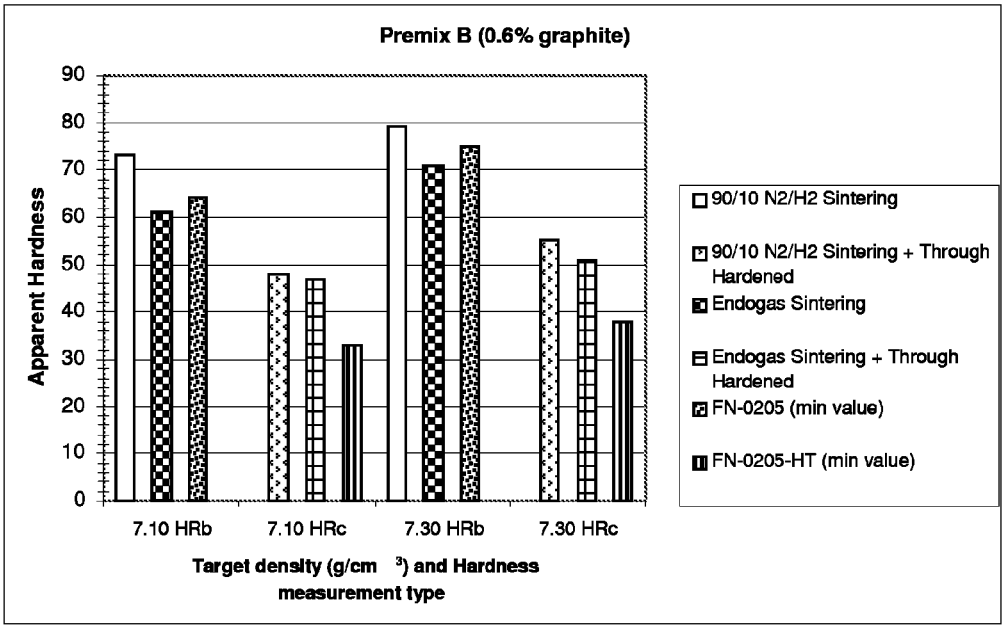
FIG. 10 shows apparent hardness obtained after sintering and heat treatment for premix B.

Dimensional change (DC) during sintering and heat treatment was evaluated by comparing the size from die to the size of the sintered product. The following FIGS. 7-8 show the result compared to what was obtained for the material FN-0205-HT steels according to MPIF standard 35 having no Cu addition and 2% of Cu. The FN 0205 samples were produced from compositions based on the iron powder AHC100.29 available from Höganäs AB, Sweden, and mixed with Ni powder and when applicable further mixed with Cu powder.

The FIGS. 7-8 show that sintering in nitrogen/hydrogen atmosphere results in slight shrinkage while endogas sintering results in a slight growth in dimensions. Both materials show much lower dimensional change compared to FN-0205-HT steels.

Sintered and through hardened material produced from premix B obtained much higher apparent hardness than the minimum required values according to MPIF standard 35 for similar processed FN-0205-HT.

Figure 11:
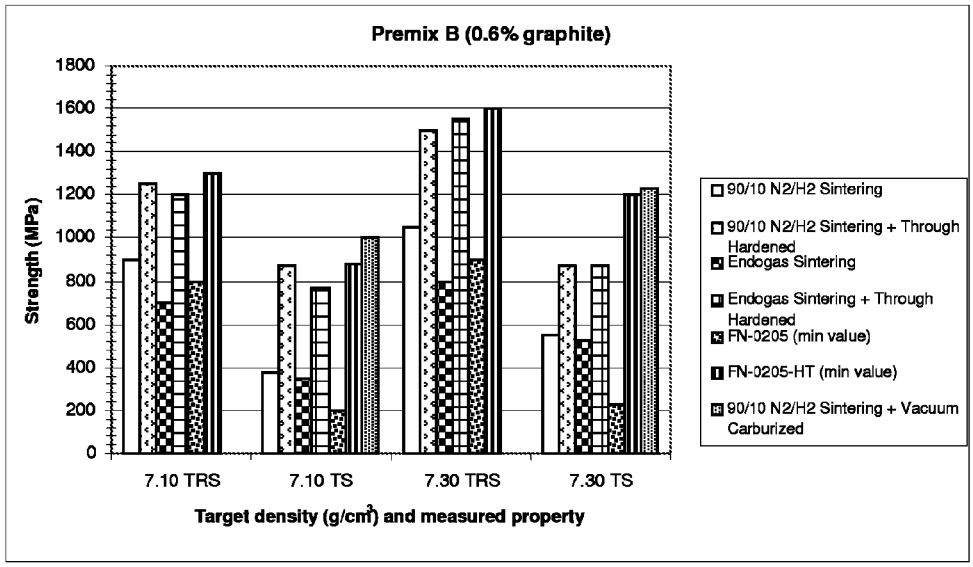
FIG. 11 shows transverse rupture strength (TRS) and tensile strength (TS) for premix B.
Figure 12:
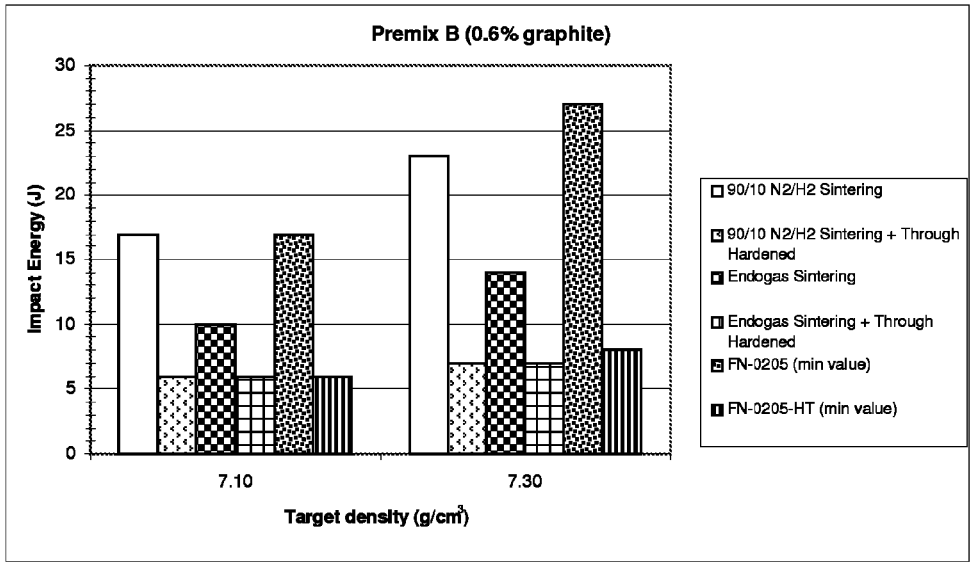
FIG. 12 shows impact energy for premix B.

Transverse rupture strength (TRS), tensile strength (TS) and impact energy obtained from sintered and through hardened material produced from premix B is shown in FIGS. 11-12.

As expected the transverse rupture strength increased with increased density. The results show that specimens produced from the new powder compare well to minimum required values for FN-0205 and FN-0205-HT materials with respect to transverse rupture strength, impact energy and tensile strength. After vacuum carburization, specimens produced from the new powder even exceed FN-0205 requirements.

The invention claimed is:

1. A pre-alloyed iron-based powder comprising the following alloying elements:

0.2-1% by weight of Cr,
0.05-0.15% by weight of Mo,
0.1-1% by weight of Ni,
0.09-0.3% by weight of Mn,
0.01% by weight or less of C,
less than 0.25% by weight of O, and
less than 1% by weight of inevitable impurities, the balance being iron.

2. The pre-alloyed iron-based powder according to claim 1, wherein the content by weight of Cr is within the range of 0.3-0.7%, and the content by weight of Ni is within the range of 0.3-0.7%.

3. A powder composition comprising a pre-alloyed iron-based powder according to claim 2, mixed with 0-1% by weight of the composition of graphite, optionally up to 0-1% by weight of lubricants, and optionally admixed with Mn-containing powders and/or Cu-containing powders and/or Ni-containing powders, and optionally mixed other additives such as hard phase material, machinability improving agents and flow enhancing agents.

4. A component made by subjecting the composition according to claim 3 to compaction between 400-2000 MPa, followed by a sintering process at 1000-1400° C., followed by heat treatment.

5. The powder composition comprising a pre-alloyed iron-based powder according to claim 1, mixed with 0-1% by weight of the composition of graphite, optionally up to 0-1% by weight of lubricants, and optionally admixed with Mn-containing powders and/or Cu-containing powders and/or Ni-containing powders, and optionally mixed other additives such as hard phase material, machinability improving agents and flow enhancing agents.

6. A component made by subjecting the composition according to claim 5 to compaction between 400-2000 MPa, followed by a sintering process at 1000-1400° C., followed by heat treatment.

7. The component according to claim 6 having a transverse rupture strength (TRS) of at least 1150 MPa when sintered to 7.10 g/cm$^3$ density and of at least 1450 MPa when sintered to 7.30 g/cm$^3$ density.

8. The component according to claim 6 with dimensional change from die to as sintered size of at most ±0.2%, when sintered to densities in the range of 7.10-7.30 g/cm$^3$.

9. A component made by subjecting the composition according to claim 5 to compaction between 400-1000 MPa, followed by sintering at 1100-1300° C., followed by heat treatment.

10. A component made by subjecting the composition according to claim 5 to compaction between 500-900 MPa, followed by sintering at 1100-1300° C., followed by heat treatment.

11. The pre-alloyed iron-based powder according to claim 1, wherein the content by weight of Mn is within the range of 0.10% to 0.30%.

12. The pre-alloyed iron-based powder according to claim 11, wherein the content by weight of Cr is within the range of 0.3-0.7%, and the content by weight of Ni is within the range of 0.3-0.7%.

13. A pre-alloyed iron-based powder consisting of the following alloying elements and iron:

0.2-1% by weight of Cr,
0.05-0.15% by weight of Mo,
0.1-1% by weight of Ni,
0.09-0.3% by weight of Mn,
0.01% by weight or less of C,
less than 0.25% by weight of O, and
less than 1% by weight of inevitable impurities, the balance being iron.

14. A powder composition comprising a pre-alloyed iron-based powder according to claim 13, mixed with 0-1% by weight of the composition of graphite, optionally up to 0-1% by weight of lubricants, and optionally admixed with Mn-containing powders and/or Cu-containing powders and/or Ni-containing powders, and optionally mixed other additives such as hard phase material, machinability improving agents and flow enhancing agents.

15. A component made by subjecting the composition according to claim 14 to compaction between 400-2000 MPa, followed by a sintering process at 1000-1400° C., followed by heat treatment.

16. A component made by subjecting the composition according to claim 14 to compaction between 400-1000 MPa, followed by sintering at 1100-1300° C., followed by heat treatment.

17. A component made by subjecting the composition according to claim 14 to compaction between 500-900 MPa, followed by sintering at 1100-1300° C., followed by heat treatment.

18. The pre-alloyed iron-based powder according to claim 13, wherein the content by weight of Mn is within the range of 0.10% to 0.30%.

19. The pre-alloyed iron-based powder according to claim 18, wherein the content by weight of Cr is within the range of 0.3-0.7%, and the content by weight of Ni is within the range of 0.3-0.7%.

20. A method for producing a sintered component comprising the steps of:

a) preparing an iron-based steel powder composition according to claim 5,
b) subjecting the composition to compaction between 400 and 2000 MPa,
c) sintering the obtained green component in a reducing atmosphere at temperature between 1000-1400° C., and
d) subjecting the obtained sintered component to heat treatment.

21. The method according to claim 20, wherein the sintering temperature used is 1050-1220° C., and the sintering atmosphere comprises endogas having a partial pressure of oxygen of $10^{-15}$ to $10^{-16}$.

22. The method according to claim 20, wherein the sintering temperature is 1200-1400° C., and where the steel powder composition has been admixed with an Mn-containing powder.

23. The method according to claim 22, wherein said Mn-containing powder is FeMn.

24. The method according to claim 20, wherein the heat treatment atmosphere used comprises endogas having a partial pressure of oxygen of $10^{-15}$ to $10^{-16}$.

* * * * *